United States Patent [19]

Grooms

[11] Patent Number: 4,619,011

[45] Date of Patent: Oct. 28, 1986

[54] MECHANICAL CHIMNEY SWEEP

[76] Inventor: Ronald L. Grooms, 2280 W. Ustick Rd., P.O. Box 615, Meridian, Id. 83642

[21] Appl. No.: 721,271

[22] Filed: Apr. 8, 1985

[51] Int. Cl.[4] ..... F23J 3/00

[52] U.S. Cl. ..... 15/163; 15/243; 110/119

[58] Field of Search ..... 15/162, 163, 243, 249; 110/119, 121; 126/16

[56] References Cited

U.S. PATENT DOCUMENTS

| | | | |
|---|---|---|---|
| 2,976,796 | 3/1961 | Anthony et al. | 110/119 X |
| 4,483,038 | 11/1984 | Boehland et al. | 15/163 X |
| 4,543,681 | 10/1985 | Ryden | 15/163 |

FOREIGN PATENT DOCUMENTS

| | | | |
|---|---|---|---|
| 50194 | 10/1911 | Austria | 126/16 |
| 2653305 | 6/1978 | Fed. Rep. of Germany | 15/163 |

*Primary Examiner*—Peter Feldman

*Attorney, Agent, or Firm*—Paul F. Horton

[57] ABSTRACT

A mechanical chimney sweep including a spark arrester; a winch-pulley-cable assembly; a brush attached to the cable; and a counterweight depending from the brush. The spark arrester, which prevents lit material from exiting the flue, is attachable to a flue lining or flue pipe by means of a bracket without screws, bolts, or other fastening devices. The arrester supports the pulley about which the cable is threaded; the winch being externally mounted, as on the side of a house. The counterweight serves as a weight for moving the brush down the flue for cleaning and also functions as a weight holding the spark arrester in place.

2 Claims, 2 Drawing Figures

MECHANICAL CHIMNEY SWEEP

BACKGROUND OF THE INVENTION

1. Field of the Invention

This invention relates, in general, to chimney sweep apparatus, and, in particular, to chimney sweep apparatus in combination with a spark arrester.

2. Description of the Prior Art

Chimney sweep apparatus including a winch, cable, pulley assembly and brush attached to the cable are widely found in the art. Such apparatus is most often made an integral part of the flue and thus removal for repairs or maintenance is very difficult and time consuming. Even where not integral, the apparatus must be disassembled for removal. Further, the pulley support is often a cap affixed to the end of the flue by screws, bolts, or other fastening devices without providing spark arrest. Where spark arresters are included, they are fastened by screws, bolts, or the like requiring the fastening and unfastening procedures inherent therewith. Not only are such procedures cost ineffective but mutilation of either arrester or flue lining often results with the requirement of new holes being drilled.

SUMMARY OF THE INVENTION

The present invention solves these problems by providing mechanical chimney sweep apparatus which includes a spark arrester adapted for placement on an existing flue liner or flue pipe without the use of fasteners; a winch-cable-pulley assembly; a flue cleaning brush; and a counterweight providing a weight for movement of the brush down a flue and for holding the arrester firmly in place. A more thorough description may be found in the appended claims.

It is therefore a primary object of the present invention to provide chimney cleaning apparatus which includes a spark arrester.

More particularly, it is an object of the present invention to provide chimney cleaning apparatus which provides a spark arrester which is mountable to an existing flue pipe or liner without the use of fasteners.

Even more particularly, it is an object of the present invention to provide chimney cleaning apparatus which provides a spark arrester which is mountable to an existing flue pipe or liner without the use of fasteners and which utilizes a single counterweight for both the lowering of the cleaning brush and for holding the arrester in place.

A more general object of the present invention is to provide chimney cleaning apparatus which is readily removable from an existing flue liner or pipe for repairs and maintenance.

Another object of the present invention is to provide chimney sweeping apparatus which is readily operable from the exterior of a building.

Additional objects and advantages will become apparent and a more thorough and comprehensive understanding may be had from the following description taken in conjunction with the accompanying drawings forming a part of this specification.

DETAILED DESCRIPTION OF THE INVENTION

Figure 1:
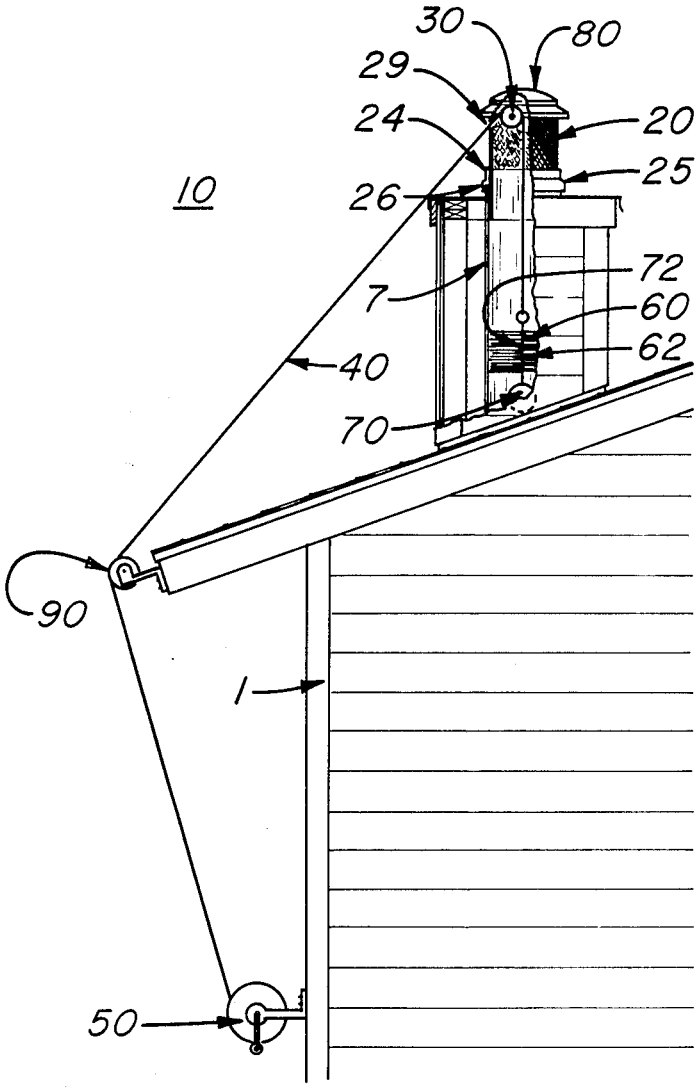
FIG. 1 is a side elevation in partial section of the present invention as mounted on an existing structure.

Referring now to the drawings, and more particularly to FIG. 1, and embodiment to be preferred of mechanical chimney sweep apparatus 10, made according to the present invention is disclosed. Sweep 10 includes a spark arrester 20, a pulley 30 supported by the arrester, a cable 40, a winch 50, a brush 60, and a counterweight 70.

The spark arrester 20, one of several preferable embodiments which may be used, is made to conform to the flue pipe or liner 7 into which it is inserted. Flue pipes extend through a building structure and are not surrounded by supporting structure. Flue liners, on the other hand extend up through a brick chimney, supported by the chimney, and normally protruding 3 or 4 inches above the chimney. "Chimney" as used herein includes either a flue lining or flue pipe. The liners or pipes are most often circular or rectangular in horizontal cross section and therefore the arrester is made to conform to the shapes, being slightly smaller in diameter so as to insert into the liner or pipe. The tubular arrester may be made of any suitable material having openings for screening any ignited material which may be carried up the flue. It is preferred that the arrester be made of expanded metal. About the exterior periphery of the arrester is welded or otherwise attached one or more brackets 25 operable to engage the top lip or rim of the flue liner or pipe. While it is preferred that the bracket extend about the entire periphery of the arrester, three or more individual brackets may be used on circular chimneys and four or more on rectangular chimneys.

Brackets 25 are of substantially inverted L-shape in configuration having a top horizontally extending portion 24 which rests upon the pipe or liner 7 and a downwardly depending lip 26 which engages the exterior surface of the liner. It will be seen, then, that the arrester simply inserts into the liner 7, the arrester being prevented from downward movement by portion 24 of the bracket or brackets, and prevented from lateral movement by the lip 26 of the bracket and by the arrester itself, in its contact with the interior surface of the liner. It will also be obvious that the arrester can be removed or installed by simply lifting the arrester straight up or down, as the case may be.

Figure 2:
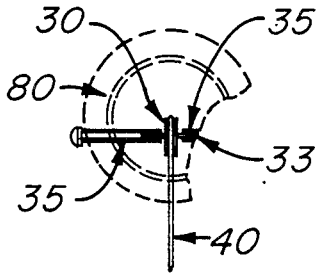
FIG. 2 is a plan view of the pulley showing a partial view of the cap in outline.

Pulley 30 is preferably mounted directly to arrester 20, as shown in FIG. 2, with the shaft 33 affixed to the sides of the arrester and the rotatable pulley centered as by sleeves 35. The pulley may be mounted to protective cap 80, which is supported by the arrester. Protective cap 80, which is optional but highly desirable, may be affixed to the arrester by any conventional means.

Cable 40 is threaded onto a winch 50, which is preferably mounted on the side of house or other structure 1, as shown in FIG. 1. The cable is then threaded over a pulley 90, mounted to house 1 to prevent contact with the eaves of the house, then enters arrester 20 by means of a slot 29, and is then threaded over pulley 30 with the free terminal end of the pulley being within the enclosure defined by the arrester 20 or liner 7. A flexible steel cable of suitable diameter is contemplated.

Affixed to the free end of cable 40 is a flue brush 60 which may be conventional in the art. The brush has a multiplicity of steel bristles 62 for contacting and cleaning the side walls of the flue liner or pipe, the brush conforming to the shape of the chimney.

Attached to brush 60 is a counterweight 70. The counterweight weighs, in the embodiment preferred, approximately eighteen pounds. While the brush and counterweight may be integral in design, it is preferred that the counterweight, made of iron or steel, downwardly depend from the brush, as by a short cable or chain 72. In this manner, the brush is maintained with its bristles 62 in a horizontal position for superior cleaning. It is to be noted that besides pulling the brush down the flue by gravitational force, that the counterweight 70 also acts to place a downward weight on arrester 20 in the cables contact with pulley 30 which is affixed to the arrester.

To operate the chimney sweep, ahd assuming the apparatus is installed, as shown in FIG. 1, winch 50 is unlocked and the handle rotated to lower the brush 60, weighted by counterweight 70, downwardly into flue pipe or liner 7 to clean the walls of the chimney. By rotating the handle of the winch in the opposite direction, the brush is brought to the top of the flue, brush 60 cleaning the walls as it is moved upwardly. This process is then repeated any desired number of times. It is obvious that winch 50 may be electrically powered as well as manually powered.

To remove the sweep for maintenance or repairs from liner 7, the brush with attached counterweight is brought by the winch to the uppermost part of the liner. Arrester 20 is then simply pulled up vertically from the liner, thus removing the arrester, cable 40, pulley 30, brush 60, and counterweight 70. To replace the device, the arrester, with other structural elements in position, is simply lowered onto the flue with brackets 25 engaging the uppermost part of the flue.

Having thus described in detail a preferred embodiment of the present invention, it is to be appreciated and will be apparent to those skilled in the art that many physcial changes could be made in the apparatus without altering the inventive concepts and principles embodied therein. The present embodiments are therefore to be considered in all respects as illustrative and not restrictive, the scope of the invention being indicated by the appended claims rather than by the foregoing description, and all changes which come within the meaning in range of equivalency of the claims are therefore to be embraced therein.

I claim:

1. Mechanical chimney sweep apparatus for chimneys of the type having a flue pipe or liner, said apparatus comprising:

a spark arrester, tubular in shape, and provided with a multiplicity of openings in the side wall thereof, said arrester insertable into said flue pipe or liner, and said arrester provided with one or more brackets, substantially inverted L-shape in form, said brackets operable to engage the top lip and exterior surface of said flue pipe or liner;

a pulley supported by said arrester;

an externally mounted winch;

a cable attached to one end to said winch, engaging said pulley, and terminating at the other end within the enclosure defined by said arrester and said flue pipe or liner;

a brush for cleaning the walls of said pipe or liner, said brush affixed to the end of said cable; and a counterweight attached to said cable and downwardly depending from said brush.

2. The apparatus as described in claim 1 wherein said arrester includes a single bracket extending about the entire periphery of said arrester.

* * * * *